US005249683A

United States Patent [19]

Baucom

[11] Patent Number: 5,249,683

[45] Date of Patent: Oct. 5, 1993

[54] MOUNTING DEVICE FOR DISPLAYING PACKAGED THREE DIMENSIONAL ARTICLES AND ARTICLE DISPLAY FORMED THEREWITH

[75] Inventor: Larry H. Baucom, Mint Hill, N.C.

[73] Assignee: L & S Design, Inc., Mint Hill, N.C.

[21] Appl. No.: 886,764

[22] Filed: May 21, 1992

[51] Int. Cl.[5] ..... B65D 73/00

[52] U.S. Cl. ..... 206/462; 206/486; 211/72

[58] Field of Search ..... 206/461-471, 206/486, 488, 489, 806; 211/71-73

[56] References Cited

U.S. PATENT DOCUMENTS

| | | | |
|---|---|---|---|
| 689,377 | 12/1901 | Beiser . | |
| 1,436,337 | 11/1922 | Burger . | |
| 2,050,270 | 8/1936 | Burnham | 206/489 |
| 2,956,677 | 10/1960 | Kavadlo | 206/463 |
| 3,040,881 | 6/1962 | McNeill | 206/488 |
| 3,144,343 | 8/1964 | Fritsche | 206/463 |
| 3,184,319 | 5/1965 | Fritsche | 206/462 |
| 3,352,415 | 11/1967 | Seely et al. | 206/465 |
| 3,390,766 | 7/1968 | Stockdale | 206/486 |
| 3,429,451 | 2/1969 | Samsing | 206/465 |
| 3,756,398 | 9/1973 | Green et al. . | |
| 4,312,449 | 1/1982 | Kinderman | 206/466 |
| 4,651,873 | 3/1987 | Stolcenberg et al. | 206/486 |
| 4,726,466 | 2/1988 | Cooper | 206/486 |

FOREIGN PATENT DOCUMENTS

| | | | |
|---|---|---|---|
| 1269572 | 4/1972 | United Kingdom | 206/486 |

*Primary Examiner*—Jimmy G. Foster
*Attorney, Agent, or Firm*—Shefte, Pinckney & Sawyer

[57] ABSTRACT

Collectible and other consumer articles packaged for retail sale on a supporting card can be displayed intact in their original packaging by a mounting board formed with openings each of a shape and size conforming to the packaged article by mounting each package to the rearward side of the mounting board with the article protruding forwardly through a respective opening and the card abutting the rearward side of the board, so that substantially only the articles are displayed at the forward face of the board and the supporting cards are masked by the board.

2 Claims, 2 Drawing Sheets

MOUNTING DEVICE FOR DISPLAYING PACKAGED THREE DIMENSIONAL ARTICLES AND ARTICLE DISPLAY FORMED THEREWITH

BACKGROUND OF THE INVENTION

The present invention relates generally to display devices and, more particularly, to a mounting device by which a plurality of three-dimensional consumer articles can be attractively displayed while still intact in their original packaging.

Virtually countless numbers of consumer articles are packaged for retail sale in display packages basically comprising a supporting card on which the consumer article is mounted so as to be visible when displayed on a conventional retail store rack, case, shelf, or other display structure. Typically, the supporting card provides the two-fold function of serving as a hanger for the packaged article it carries, while also bearing printed text and artwork intended to visually attract consumers. One of the most common forms of retail packaging of the aforementioned type are so-called "blister" packages wherein the packaged consumer article is contained within a transparent plastic enclosure conformed substantially in shape and size to the article, the plastic enclosure with the contained article being affixed to the forward face of the supporting card to project outwardly therefrom and thereby prominently display the packaged article.

While it is desirable to a retailer selling such packaged articles to afford maximum exposure to the supporting card in order to achieve optimal benefit of its intended function in attracting consumers, the supporting card and the plastic "blister" enclosure for the packaged article normally has no value at all to the consumer and it therefore is typically discarded immediately following purchase.

Occasionally, however, such packaged articles may quickly achieve collectible status among a segment of the consuming public to whom the value of the articles is enhanced or maximized if the articles are retained intact in their original packaging. By way of example, but without limitation, metal die-cast reduced-scale automobile models of authentic racing stock cars have in recent years become highly collectible items to racing memorabilia collectors. Likewise, another sports-related consumer item which has become highly popular among sports memorabilia collectors in recent years are miniature figurines of current and past baseball, football, and basketball superstars. In each case, such articles which remain in original condition intact in their original packaging have substantially escalated in market value several times their original retail price. Unfortunately, in contrast to the retailer's marketing desire to maximize exposure of the supporting card of such packages, a collector's primary interest is in the packaged article itself and the packaging is an inconvenience and annoyance which the collector endures only in order to maximize the collectible value of the article. In particular, most collectors are not content to simply place such collectible item in a suitable storage container or location but, rather, naturally desire to display their collection. However, when collectible articles are maintained in their original packaging, the packaging makes it difficult, if not impossible, to neatly and compactly display a sizable collection and, further, tends to detract from the attractiveness of any such display.

SUMMARY OF THE INVENTION

It is accordingly an object of the present invention to provide a novel device by which collectors of articles sold in the described type of packaging can neatly, compactly, and attractively display the collectible articles while still intact in their original packages, but without the packaging detracting visually from the displayed articles.

Briefly summarized, the present invention accomplishes the foregoing objective by providing a mounting device for displaying a plurality of card-mounted articles intact on their original packaging in an array wherein each individual article is fully visible as packaged, but the packaging itself is substantially masked from view. The present mounting device is broadly intended and adapted for displaying virtually any three-dimensional articles of the type packaged on a supporting card from which the article protrudes outwardly from at least one face of the card. Basically, the mounting device comprises an opaque mounting board having a rearward mounting side and a forward display side, the mounting board being formed with a plurality of openings generally conforming to the packaged shape of the articles to be displayed. The openings are located on the board in an array compatible with the size and shape of the packages for permitting each package to be received and supported by the mounting board in a disposition wherein each package's supporting card is in generally face-abutting relation to the rearward mounting side of the mounting board and the package's article extends forwardly through a respective one of the openings to be substantially visible at the forward display side of the mounting board with the package's supporting card being substantially masked by the mounting board. In this manner, substantially only the articles themselves are visible at the forward display side of the mounting board, creating an attractive display.

As will be understood multiple packages of the described type can be conveniently nested with one another with their supporting cards in overlapping relation so that their articles are compactly oriented relatively closely adjacent one another. Accordingly, in the preferred embodiment of the present mounting device, the array of openings are arranged and spaced with respect to one another in the mounting board in correspondence to the arrangement and spacing of the packaged articles when their packages are so nested.

The resultant display assembly produced by the combination of a plurality of three-dimensional articles when mounted in combination with the described mounting device forms another aspect of the present invention.

DESCRIPTION OF THE PREFERRED EMBODIMENT

Figure 1:
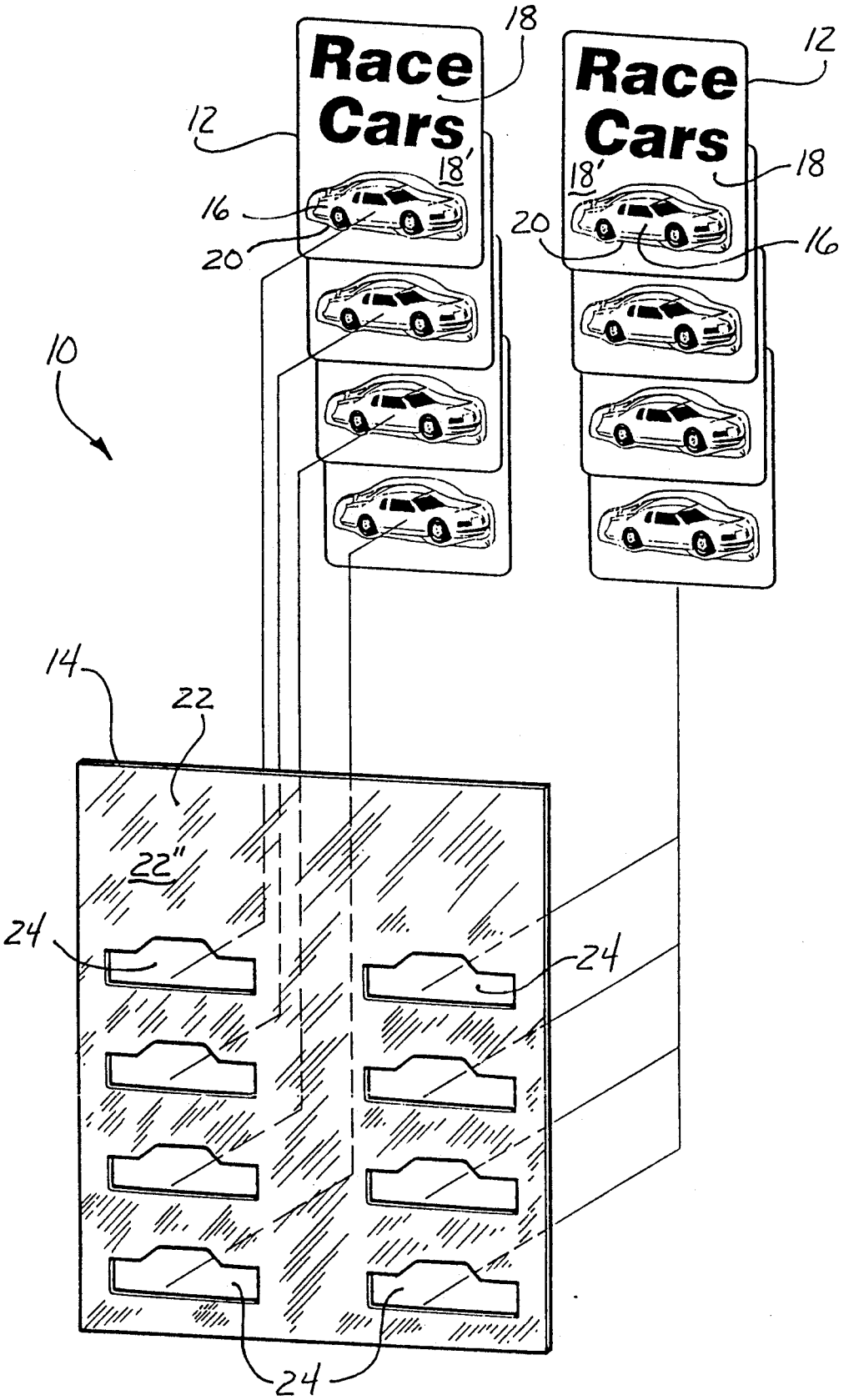
FIG. 1 is an exploded perspective view of a display formed in accordance with the present invention of a plurality of packages of card-supported three-dimensional articles mounted to a mounting device according to the present invention.
Figure 2:
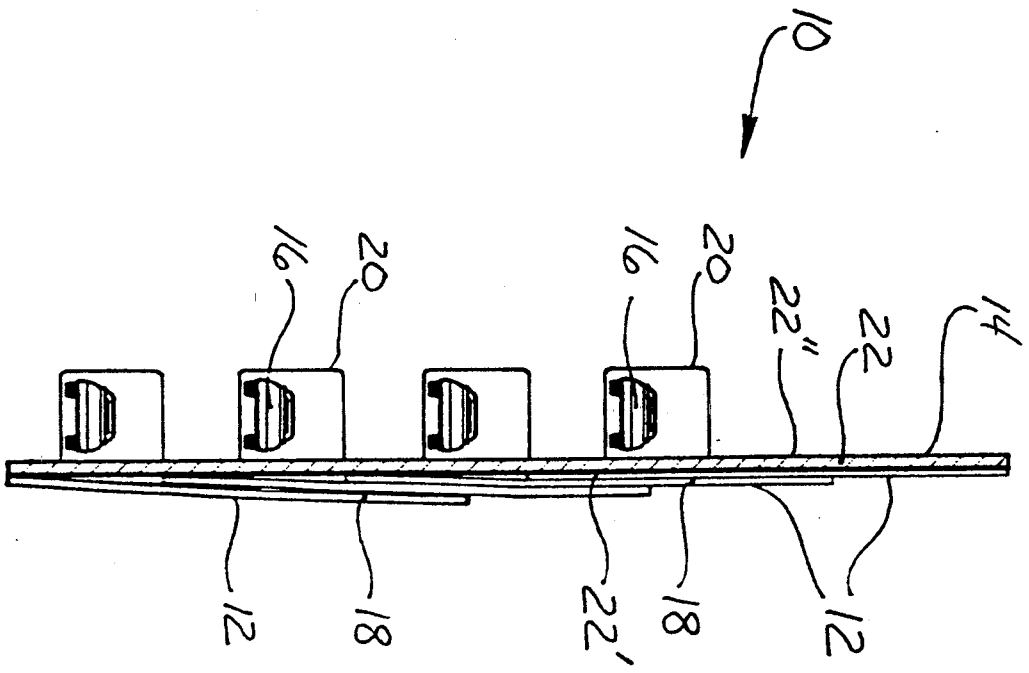
FIG. 2 is a vertical cross-sectional view of the display assembly of FIG. 1, taken along line 2—2 thereof.

Referring now to the accompanying drawings, a display according to the preferred embodiment of the present invention is broadly indicated at 10 and basically comprises a plurality of conventional article packages 12 supported by a mounting device 14 in accordance with the present invention.

The packages 12 are representative of one conventional form of package in which collectible die-cast automobile models 16 are sold, each package 12 basically including a planar hanger card 18 which supports one automobile model 16 within a transparent plastic "blister" enclosure 20 affixed to and extending outwardly from the forward face 18' of the card 18. As illustrated, any number of packages 12 of this construction can be nested with respect to one another by placing their respective cards 18 in overlapping relation so that their respective blister enclosures 20 are disposed closely adjacent one another.

The mounting device 14 comprises a planar mounting board 22, which may be formed of any suitable opaque sheet material such as, by way of example, plastic sheeting, sheet metal, or heavy gauge cardboard. A plurality of openings 24 are formed through the mounting board 22 in vertical columns with the openings 24 in each column being spaced f rom one another in correspondence to the spacing of the blister enclosures 20 when the packages 12 are overlappingly nested as aforedescribed. Each opening 24 is of a size and shape at least generally conforming to the size and shape of the blister enclosure 20 of one package 12 so as to enable the blister enclosure 20 to extend freely through the opening 24.

The use and operation of the mounting board 22 may thus be understood. To display a plurality of automobile models 16 corresponding in number to the openings 24 in the mounting board 22, the packages 12 containing the automobile models 16 are mounted to the rearward face 22' of the mounting board by extending each package's blister enclosure 20 through a correspondingly one of the openings 24 in the mounting board until the forward face 18' of the card 18 abuts the rearward face 22', causing the blister enclosure 20 to protrude fully through and beyond the forward face 22'' of the mounting board 22. This operation can be accomplished by mounting each package 12 individually to the mounting board 22 beginning at the top of each column of openings 24, whereby the nested overlapping arrangement of the packages 12 is automatically accomplished as each successive package 12 is mounted. Alternatively, the packages 12 can be initially nested and placed through the openings 24 in groups. In each case, with the mounting board 22 oriented vertically, the weight of the automobile model 16 within the blister enclosure 20, together with the interaction of the packages 12 when nested with one another, serves to maintain the packages 12 in assembled relation with the mounting board and to prevent any tendency of the packages 12 to fall from the rearward face 22' of the mounting board 22. If further security against undesired disassembly of the display 10 is desired, it is contemplated that a backing board (not shown) could be provided to affix to the rearward face 22' of the mounting board 22 to essentially sandwich the cards 18 of the packages 12 between the backing and mounting boards.

Advantageously, the mounting board 22 in the display 10 orients and supports the automobile models 16 in a neat, attractive, and compact array in which each individual model 16 is fully visible within its blister enclosure 20 from the forward face 22'' of the mounting board 22, while the body of the mounting board 22 substantially masks the cards 18 so that substantially only the models 16 are displayed. The mounting board 20 may be conveniently hung on a wall or other vertical surface like a picture frame or other wall hanging. Alternatively, the models 16 could be displayed with the packages 12 arranged on a table or other horizontal surface and the mounting board 22 placed as a mask thereover. In addition to providing the advantage of enabling a collector to display the automobile models 16 intact in their original packages without the cards 18 detracting from the appearance of the display, the present invention provides the additional advantage of protecting the cards 18 against deterioration or other damage which could affect the collectability and value of the models 16.

Of course, while the display 10 and the mounting board 10 have been described and illustrated in one preferred embodiment for displaying automobile model packages 12, it will be readily recognized by those persons skilled in the art that the mounting board 22 can be produced with virtually any number of openings 24 in any size or shape so as to be suitable for mounting and displaying substantially any type or form of collectible or consumer article packaged on a supporting card with the article protruding forwardly from the card. Specifically, it is contemplated that the mounting board 22 of the present invention can be equally well adapted for displaying articles packaged so as to protrude both forwardly and rearwardly from a supporting card, but in such circumstances, the packages 12 could not be nested or overlapped with one another in the manner shown for the automobile model packages 12.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A display of a plurality of three-dimensional articles comprising, in combination, a plurality of packages each having one of the articles supported on a planar card from which the article protrudes outwardly from at least one face of the card, and a mounting device comprising an opaque mounting board having a rearward mounting side and a forward display side, the mounting board being formed with a plurality of openings generally conformed to the packaged shape of the articles displayed, the openings being in an array compatible with the size and shape of the packages, each package being received and supported by the mounting board in a disposition wherein the one face of each package's supporting card is in generally face-abutting relation to the rearward mounting side of the mounting board and the package's article extends forwardly through a respective one of the openings to be substantially fully visible at the forward display side of the mounting board with the package's supporting card being substantially masked by the mounting board so that substantially only the articles are visibly displayed at the forward display side of the mounting board, and the mounting board being disposed in an upright orientation wherein each package's article is gravitationally maintained within its respective opening in the mounting board without requiring any additional retaining structure.

2. The combination according to claim 1, wherein the packages are nested with one another with their supporting cards in overlapping relation so that the articles are arranged relatively closely to one another in a compact array and the array of the openings are correspondingly arranged and spaced with respect to one another.

* * * * *